US005738079A

United States Patent [19]

Keller et al.

[11] Patent Number: 5,738,079

[45] Date of Patent: Apr. 14, 1998

[54] PROJECTILE LAUNCHER

[75] Inventors: Bryan R. Keller; Robert Louis Brown, both of Cincinnati, Ohio; Daniel G. Meiser, Butler, Ky.; Kurt Wierwille, Cincinnati, Ohio

[73] Assignee: Hasbro, Inc., Pawtucket, R.I.

[21] Appl. No.: 496,791

[22] Filed: Jun. 29, 1995

[51] Int. Cl.[6] ..... F41B 11/14

[52] U.S. Cl. ..... 124/66

[58] Field of Search ..... 124/8, 16, 26, 124/27, 37, 61, 59, 64–67

[56] References Cited

U.S. PATENT DOCUMENTS

| | | | |
|---|---|---|---|
| 2,633,119 | 3/1953 | Bauderer et al. | 124/27 |
| 2,888,004 | 5/1959 | Steiner . | |
| 2,964,032 | 12/1960 | Noble | 124/26 |
| 3,009,453 | 11/1961 | Ayala . | |
| 3,139,700 | 7/1964 | Wyrick | 124/26 X |
| 3,301,246 | 1/1967 | Wolfe . | |
| 3,388,696 | 6/1968 | Hoverath et al. . | |
| 3,465,744 | 9/1969 | Nielsen | 124/27 |
| 3,540,426 | 11/1970 | Lohr . | |
| 3,685,828 | 8/1972 | Getgey et al. . | |
| 4,976,249 | 12/1990 | Gagnon | 124/8 |
| 5,156,137 | 10/1992 | Clayton | 124/27 |
| 5,186,156 | 2/1993 | Clayton | 124/59 |
| 5,224,464 | 7/1993 | Burnham et al. | 124/67 |
| 5,242,323 | 9/1993 | Rappaport | 446/180 |
| 5,267,549 | 12/1993 | Webber | 124/65 |
| 5,323,755 | 6/1994 | Hsieh | 124/66 |
| 5,471,968 | 12/1995 | Lee | 124/59 X |

FOREIGN PATENT DOCUMENTS

| | | | |
|---|---|---|---|
| 1479456 | 5/1967 | France | 124/16 |

*Primary Examiner*—John A. Ricci
*Attorney, Agent, or Firm*—Kurt R. Benson

[57] ABSTRACT

A toy projectile launcher includes a body portion, two pairs of launching assemblies on the body portion, and a trigger assembly for actuating the launching assemblies for launching projectiles from the body portion. The trigger assembly includes a single trigger element which is alternatively operative for actuating one pair of the launching assemblies for simultaneously launching two projectiles or for actuating both pairs of launching assemblies for substantially simultaneously launching four projectiles.

7 Claims, 8 Drawing Sheets

PROJECTILE LAUNCHER

BACKGROUND AND SUMMARY OF THE INVENTION

The instant invention relates to toys and more particularly to a toy projectile launcher which is operative for simultaneously launching a plurality of projectiles.

It has generally been found that projectile launchers which are capable of launching relatively soft, safe foam darts have high levels of appeal both because of their play value and because they can be safely used by children. In this regard, a wide variety of toy projectile launchers of the general type which are operative for launching foam projectiles have been developed in recent years to meet the needs of an expanding market for safe projectile launcher toys. These launchers have included bow and arrows of the type disclosed in the U.S. Pat. to Burnham et at., No. 5,224,464, and foam ball launchers of the type disclosed in the U.S. Pat. to Webber, No. 5,267,549. Other projectile launchers which are operative for sequentially launching a plurality of projectiles from a magazine have also been developed, and in this regard, the U.S. Pat. to Clayton, No. 5,186,156, is exemplary. Other projectile launchers which, in addition to the launchers disclosed in the above referenced patents, represent the closest prior art to the subject invention of which the Applicants are aware are disclosed in the U.S. Pat. Nos. to Steiner, No. 2,888,004; Ayala, No. 3,009,453; Wolfe, No. 3,301,246; Hoverath et at., No. 3,388,696; Lohr et at., No. 3,540,426; Getgey et at., No. 3,685,828; Rappaport, No. 5,242,323; and Hsieh, No. 5,323,755. Nevertheless, despite the wide range of heretofore available projectile launchers which are operative for launching soft, foam projectiles, the market has continued to welcome new types of projectile launchers which are operative with new and amusing types of launching mechanisms.

The instant invention provides an exciting new type of projectile launcher which is operative for simultaneously launching a plurality of foam projectiles. More specifically, the projectile launcher of the instant invention comprises a body portion, first and second launching assemblies on the body portion for launching first and second projectiles therefrom, and an actuating mechanism comprising a single trigger element which is operative for simultaneously actuating the first and second launching assemblies for simultaneously launching the first and second projectiles from the body portion. The first and second launching assemblies preferably comprise first and second piston and cylinder assemblies which are operative for launching the first and second projectiles, respectively, by delivering blasts of compressed air thereto. The projectile launcher preferably further comprises a cocking mechanism for simultaneously moving the first and second launching assemblies to loaded positions. The projectile launcher preferably also includes third and fourth launching assemblies on the body portion for simultaneously launching third and fourth projectiles therefrom, and the trigger element is preferably further operative for actuating the third and fourth launching assemblies for launching the third and fourth projectiles from the body portion. The trigger element is preferably operative for selectively actuating one pair of the launching assemblies for launching two of the projectiles from the body portion, and the trigger element is preferably further operative for selectively substantially simultaneously actuating all four of the launching assemblies for launching all four of the projectiles from the body portion. The body portion preferably includes a pair of side portions and a handle portion extending between the side portions. The first and second launching assemblies are preferably mounted on one of the side portions, the third and fourth launching assemblies are preferably mounted on the other of the side portions, and the trigger element is preferably mounted on the handle element. The trigger element preferably comprises an elongated bar having opposite end portions on the handle portion. The trigger element is preferably further adapted so that when it is drawn rearwardly, one pair of launching assemblies is actuated during the first portion of the trigger element travel, and the second pair of launching assemblies is actuated during the last portion of the trigger element travel.

It has been found that the instant invention provides an effective projectile launcher which has a new dimension in play value. Specifically, it has been found that the projectile launcher of the instant invention has a significant level of play value as a result of being adapted to simultaneously launch a plurality of projectiles as well as being adapted to selectively launch certain groups of projectiles. It has been further found that because the launching assemblies are positioned in groups located on opposite sides of the handle portion of the housing, the projectile launcher of the instant invention can be conveniently operated for loading the launching assemblies to selectively launch groups of projectiles from the body portion.

Accordingly, it is a primary object of the instant invention to provide an effective toy projectile launcher which is operative for effectively, simultaneously launching a plurality of projectiles.

Another object of the instant invention is to provide a toy projectile launcher which is operative for selectively launching groups of projectiles.

Another object of the instant invention is to provide a toy projectile launcher which is operative for selectively launching different groups of projectiles by manipulating a single trigger element.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DESCRIPTION OF THE INVENTION

Figure 1:
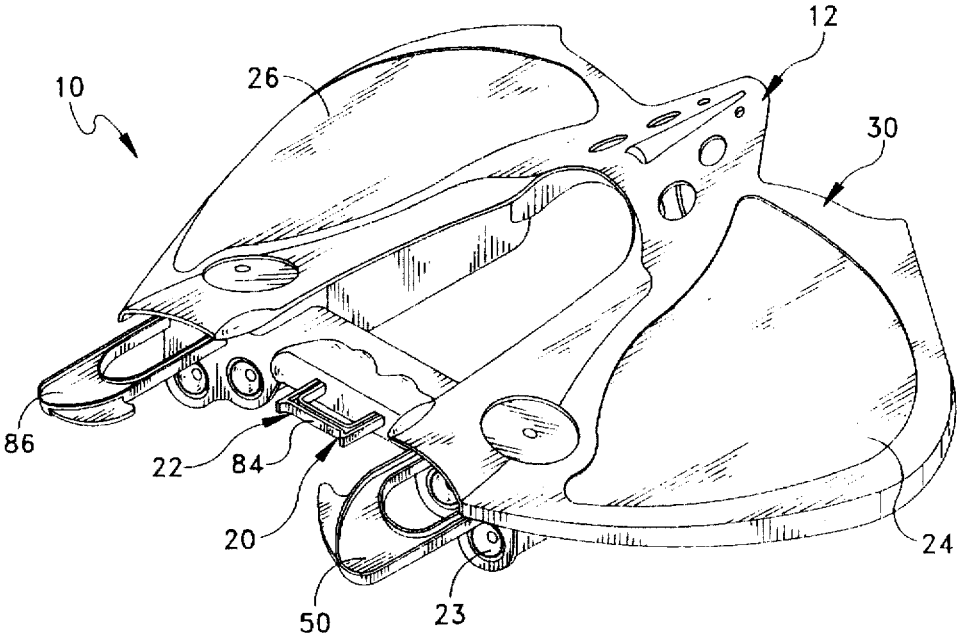
FIG. 1 is a perspective view of the toy projectile launcher of the instant invention in a loaded but uncocked position.
Figure 2:
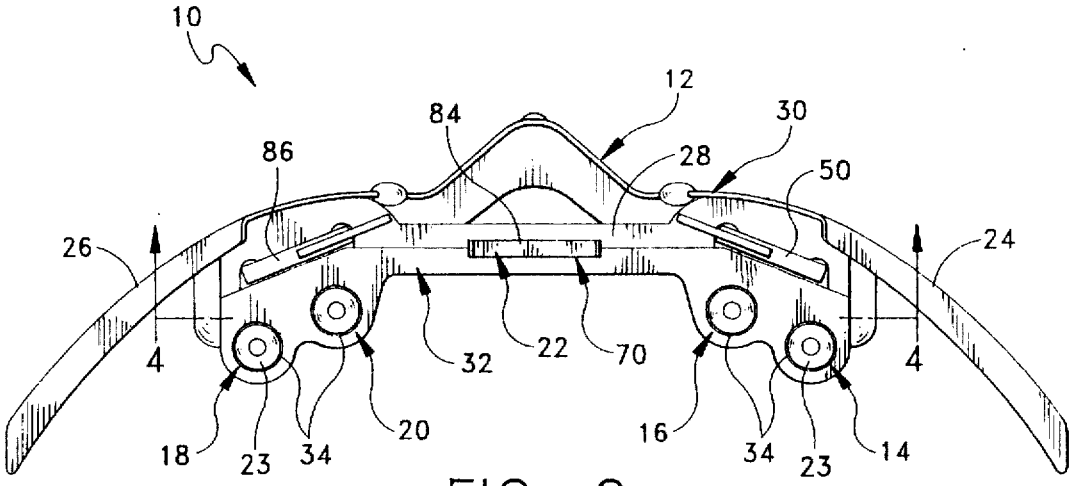
FIG. 2 is a front elevational view thereof.
Figure 3:
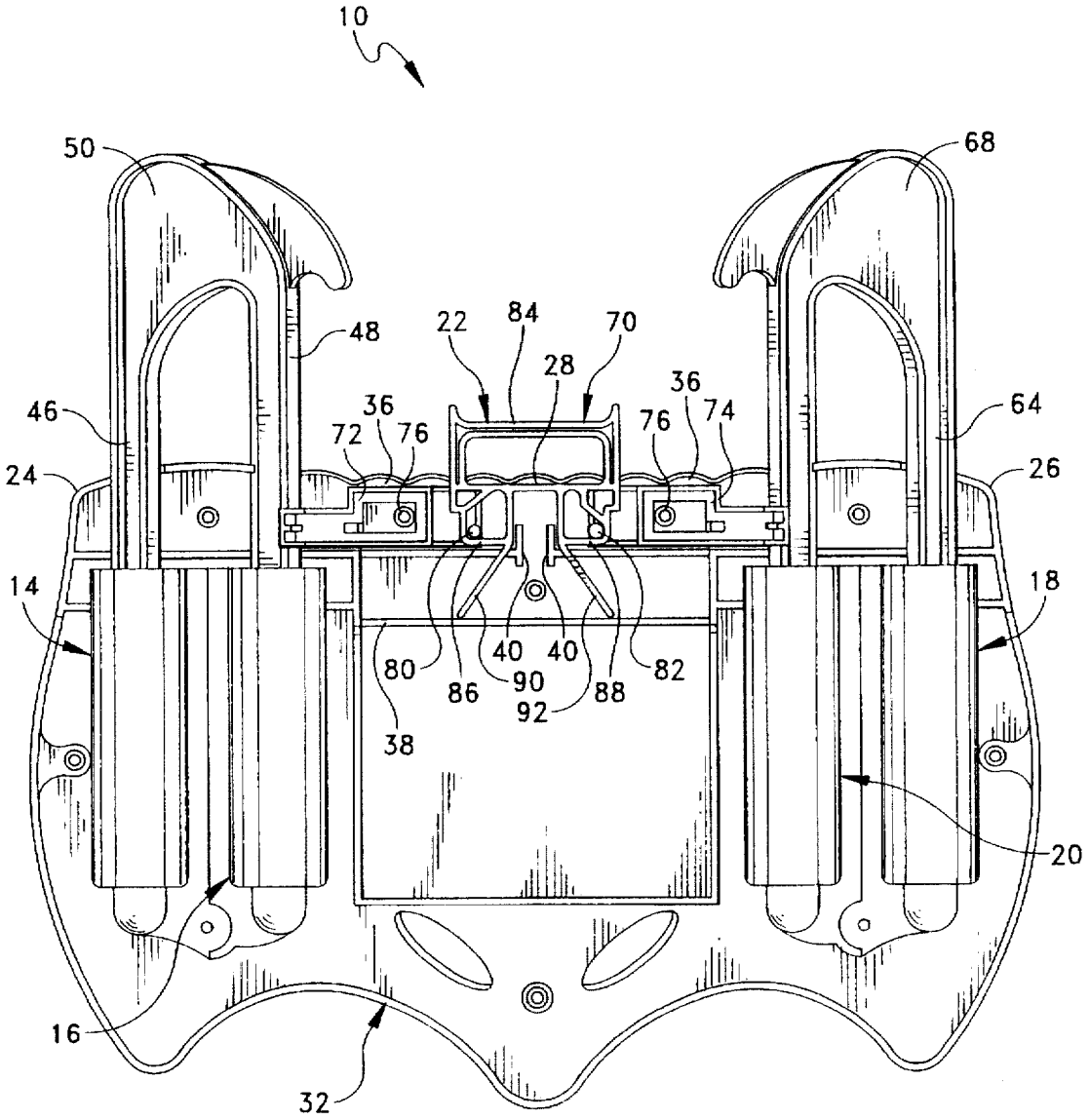
FIG. 3 is a top plan view thereof with the upper housing section removed.
Figure 4:
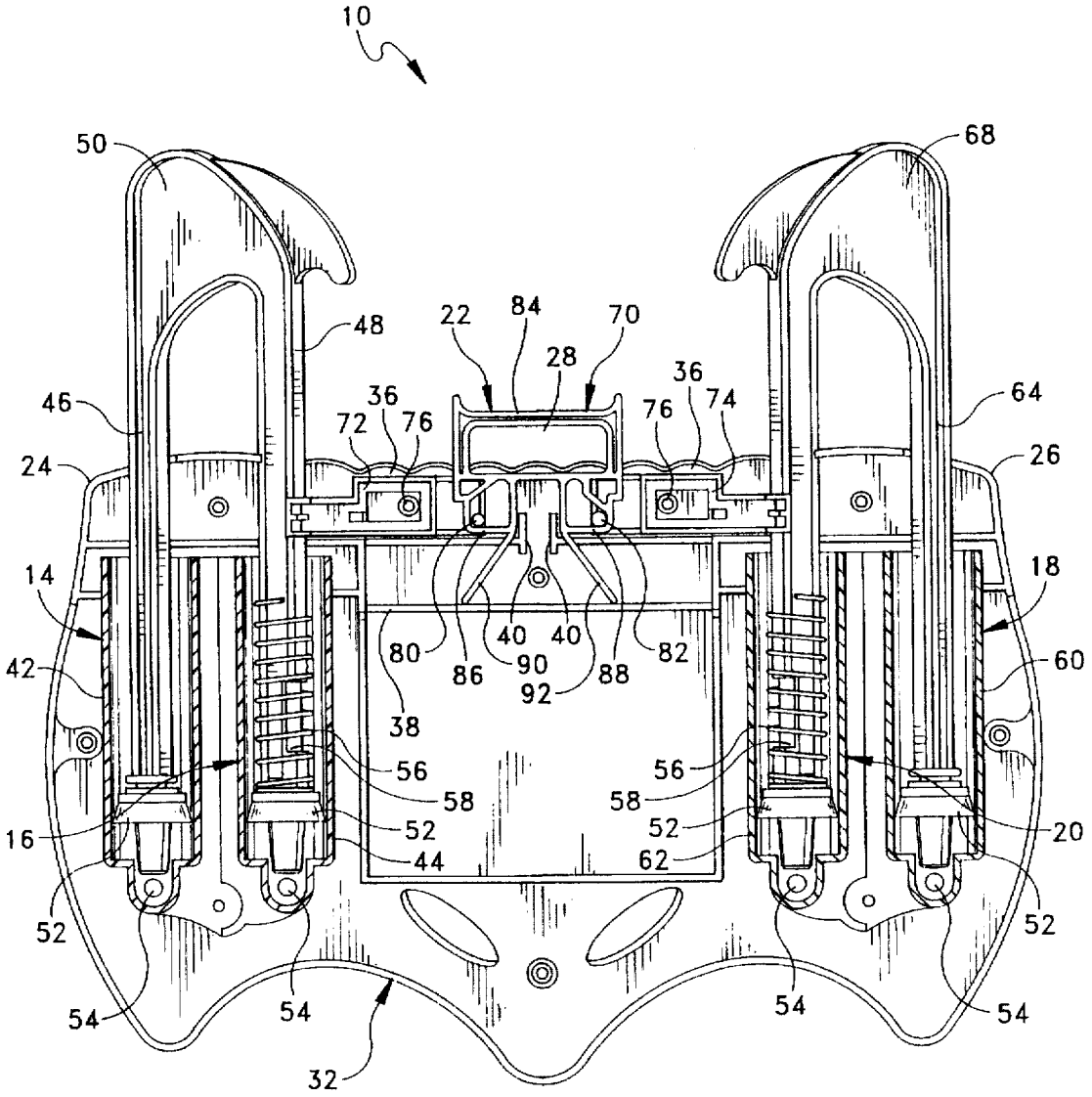
FIG. 4 is a similar view shown in partial section.
Figure 5:
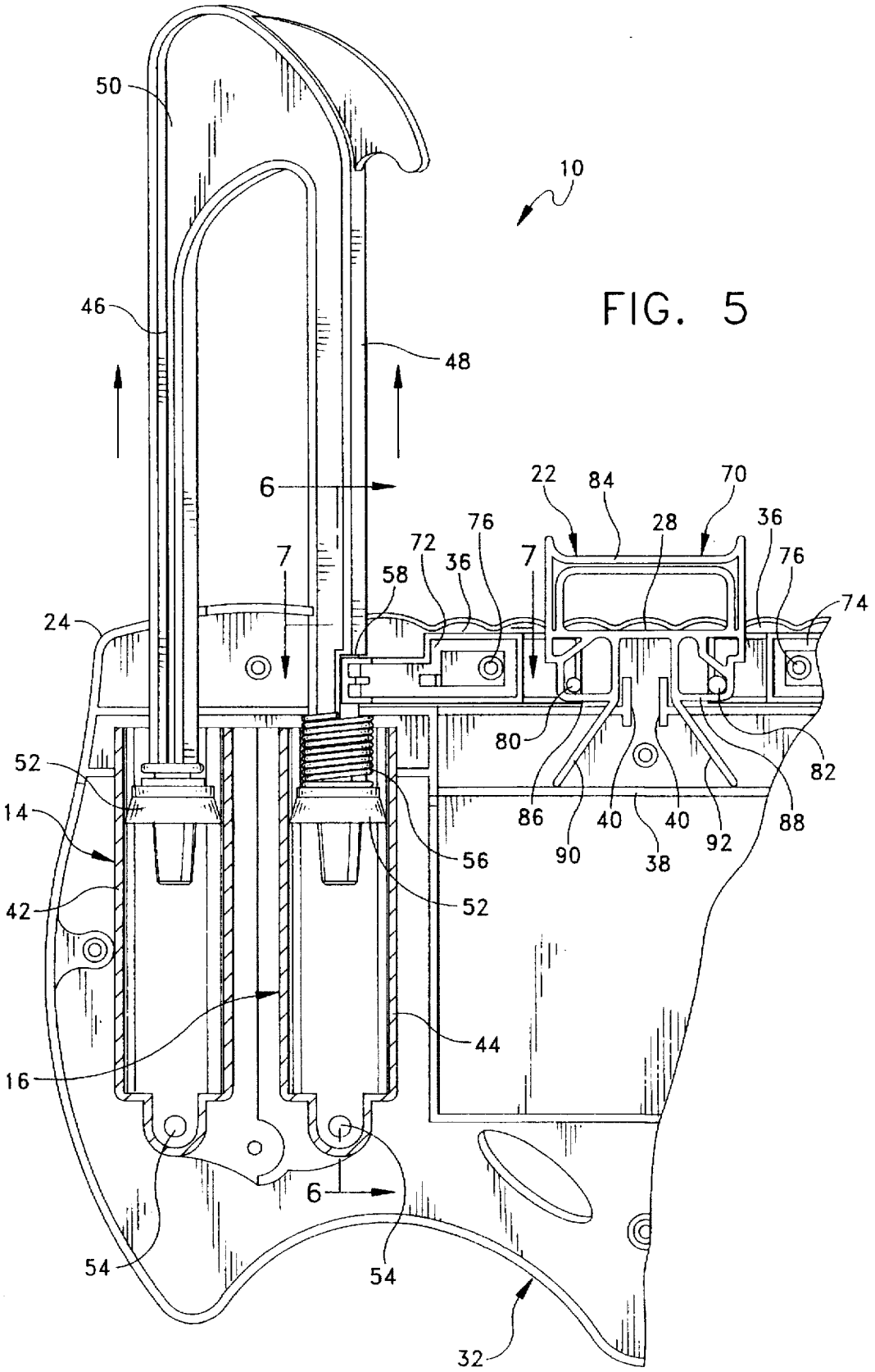
FIG. 5 is a similar enlarged fragmentary view shown in partial section.

Referring now to the drawings, the toy projectile launcher of the instant invention is illustrated in FIGS. 1–11 and generally indicated at 10 in FIGS. 1–3. The toy projectile launcher 10 comprises a body portion generally indicated at 12 containing first, second, third and fourth projectile launching assemblies generally indicated at 14, 16, 18 and 20, respectively, and an actuating trigger assembly generally indicated at 22. The projectile launching assemblies 14, 16, 18, and 20 are adapted for launching relatively soft foam projectiles 23 therefrom, and the trigger assembly 22 is operative for actuating the launching assemblies 14, 16, 18 and 20 to launch the projectiles 23 therefrom in a manner which will hereinafter be more fully set forth.

Figure 6:
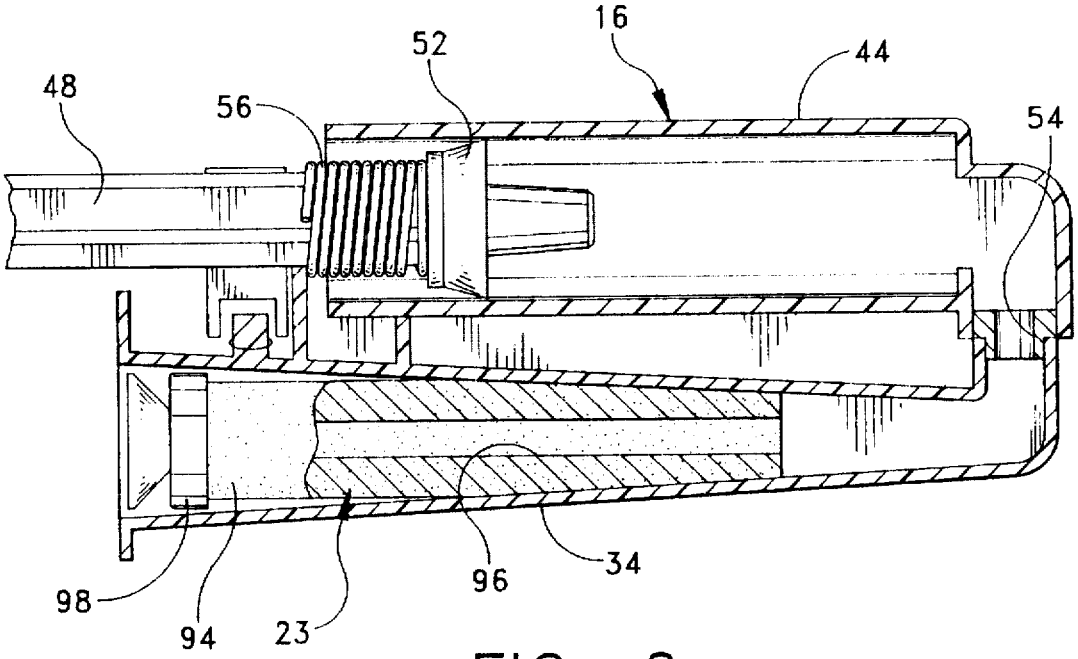
FIG. 6 is a sectional view taken along line 6—6 in FIG. 5.
Figure 9:
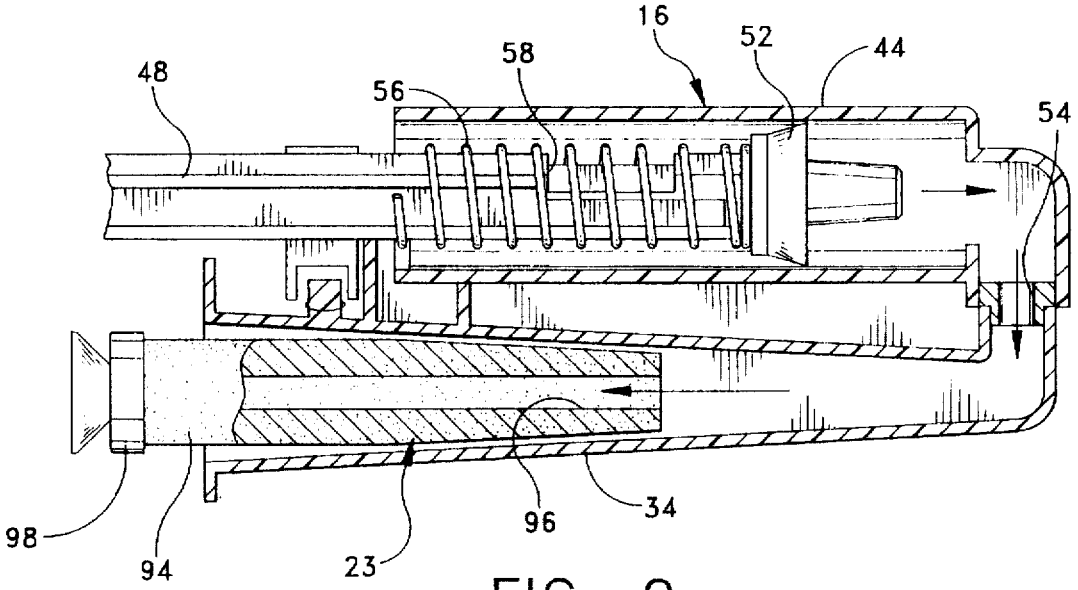
FIG. 9 is a sectional view taken along line 9—9 in FIG. 8.

The body portion 12 comprises first and second side portions 24 and 26, respectively, which are integrally joined at the rear end of the body portion 12, and a handle portion 28 which extends between the side portions 24 and 26 at the forward end of the body portion 12. The upper portions of the first and second side portions 24 and 26 and the handle portion 28 are integrally formed as an upper housing section 30, and the lower portions of the first and second side portions 24 and 26 and the handle portion 28 are integrally formed as a lower housing section 32 which is secured to the upper housing section 30 with a plurality of screws. As illustrated in FIGS. 2, 6 and 9, a plurality of launching tubes 34 are integrally formed with the lower housing section 32 so that one of the launching tubes 34 is associated with each of the launching assemblies 14, 16, 18 and 20 as will hereinafter be more fully set forth. Formed in the handle portion of the lower housing section 32 is a pair of transversely extending actuator tracks 36, and a rear wall 38 and a pair of trigger guide walls 40 is also provided in the handle portion of the lower housing section 32.

The launching assemblies 14, 16, 18 and 20 are operative for launching the projectiles 23 from the body portion 12. As illustrated most clearly in FIGS. 4 and 11, the launching assemblies 14 and 16 are formed as a first pair of launching assemblies which is mounted in the first side portion 24, and the third and fourth launching assemblies 18 and 20 are formed as a second pair of launching assemblies which are mounted in the second side portion 26. The launching assemblies 14 and 16 comprise first and second cylinders 42 and 44 containing first and second piston elements 46 and 48 which are integrally connected at a front handle portion 50. Each of the piston elements 46 and 48 has an inner seal 52 thereon, and each of the cylinders 42 and 44 includes an air discharge outlet 54. The second piston element 48 has a coil spring 56 thereon which biases both of the piston elements 46 and 48 to the rearward positions thereof in the cylinder elements 42 and 44 illustrated in FIG. 4. The piston elements 46 and 48 are, however, movable as a unit to the loaded or cocked positions thereof illustrated in FIG. 11. Further, the second piston element 48 has a notch 58 formed therein for releasably retaining the assembly comprising the piston elements 46 and 48 with the seals 52 thereon in the cocked or loaded position illustrated in FIGS. 5 and 11. The launching assemblies 18 and 20 comprise third and fourth cylinder elements 60 and 62 having air discharge outlets 54 and containing piston elements 64 and 66 having seals 52 thereon. The piston element 66 has a coil spring 56 received thereon, and the piston elements 64 and 66 are integrally joined by a forward handle portion 68. The piston element 66 has a notch 58 formed therein for releasably retaining the assembly comprising the piston elements 64 and 66 with the seal portions 52 thereon in cocked or loaded positions.

As illustrated in FIGS. 6 and 9, the air discharge outlets 54 open directly into the launching tubes 34, and the launching tubes 34 are formed in circular inwardly tapering configuration for snugly receiving the projectiles 23 therein. Accordingly, when the piston elements 46 and 48 and/or the piston elements 64 and 66 are released from the cocked positions thereof, compressed air from the corresponding cylinder elements 42, 44 or 60 and 62 is delivered to the corresponding launching tubes 34 for launching the projectiles 23 therefrom.

Figure 7:
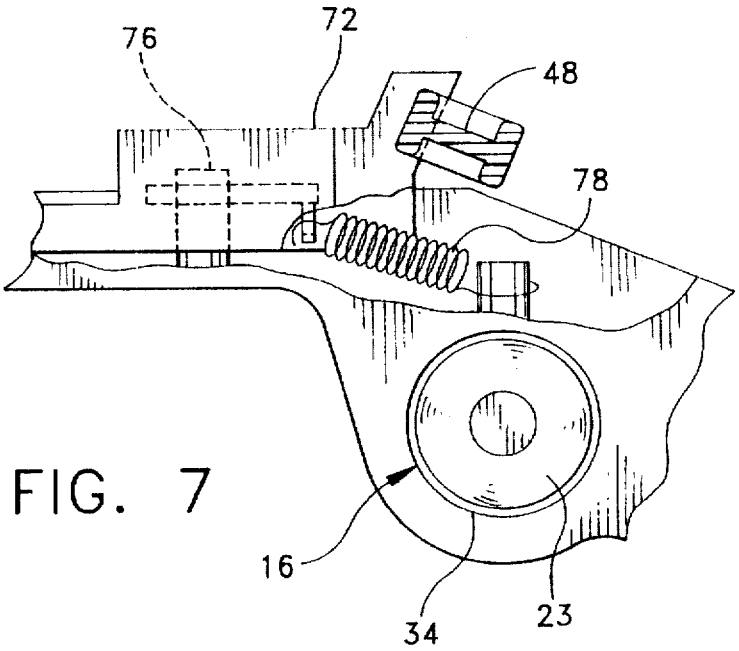
FIG. 7 is a sectional view taken along line 7—7 in FIG. 5.
Figure 8:
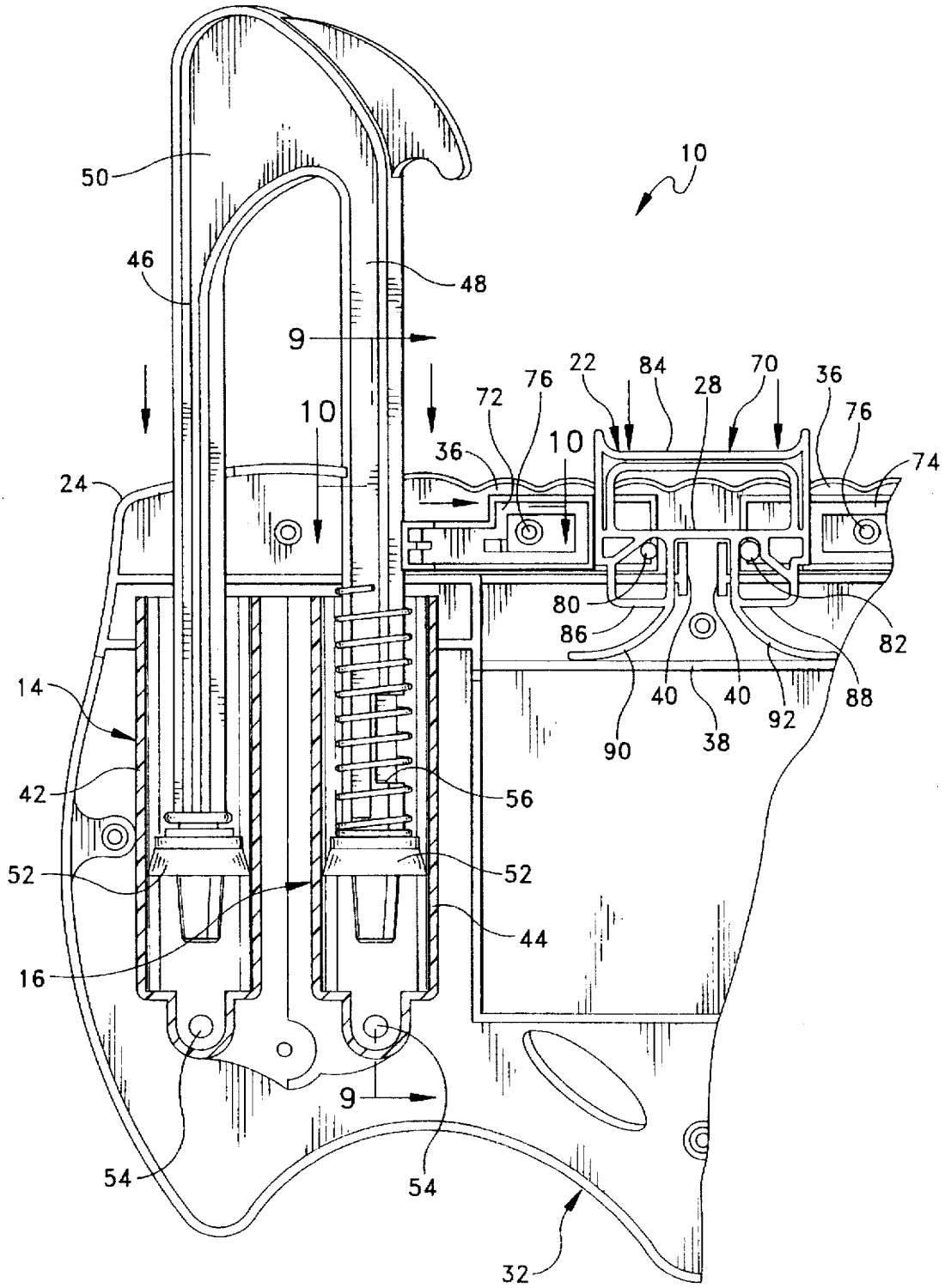
FIG. 8 is an enlarged fragmentary sectional view similar to FIG. 5 as the first and second launching assemblies are actuated.
Figure 10:
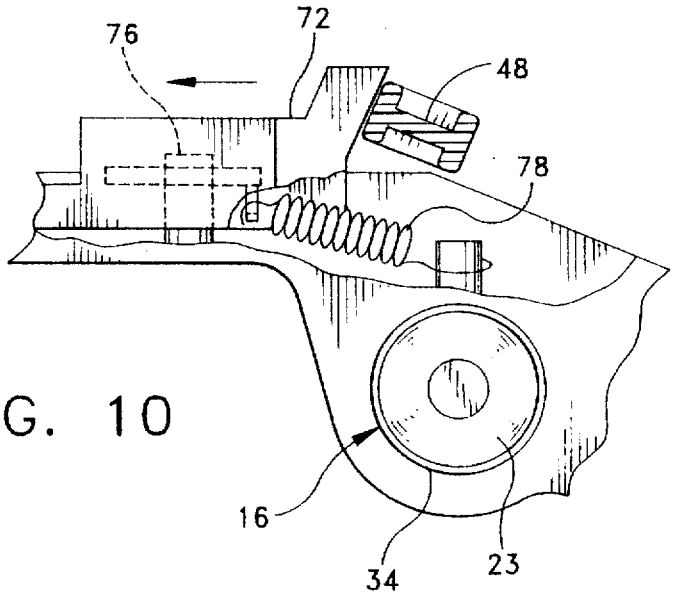
FIG. 10 is a sectional view taken along line 10—10 in FIG. 8.
Figure 11:
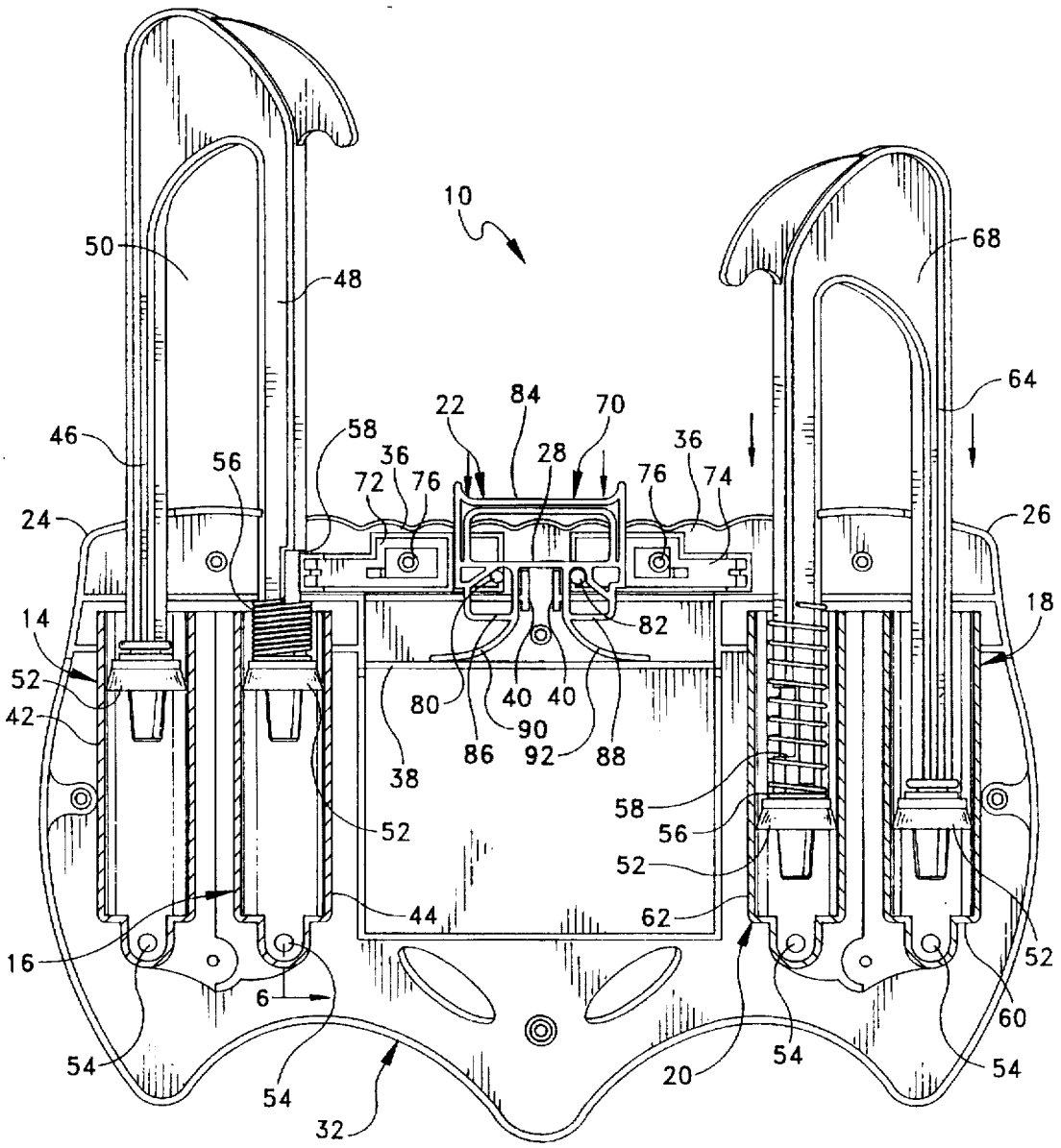
FIG. 11 is a top plan view of the toy projectile launcher in partial section with the upper housing section removed as the third and fourth projectile launching assemblies are actuated.

The actuating trigger assembly 22 comprises a trigger element generally indicated at 70 and first and second latch elements 72 and 74. The latch elements 72 and 74 are received in the actuator tracks 36, and they are slideably retained in position on pins 76 in the lower housing section 32. The latch elements 72 and 74 are biased to outward positions with springs 78 as illustrated in FIGS. 7 and 10, and they are operative for releasably engaging the piston elements 48 and 66, respectively, in the notches 58 therein in order to releasably retain the piston elements 46 and 48 or 64 and 66 corresponding thereto in cocked positions. The latch elements 72 and 74 include cam pins 80 and 82 which are received in engagement with the trigger assembly 70 for releasing the latch elements 72 and 74 from engagement with the corresponding piston elements 48 and 66 thereof. The trigger assembly 70 includes a forward crossbar portion 84, a pair of release frames 86 and 88, and a pair of integrally formed spring elements 90 and 92. The pins 80 and 82 are received in the release frames 86 and 88, respectively, so that as the trigger assembly 70 is moved rearwardly, the angular walls of the release frames 86 and 88 urge the pins 80 and 82 inwardly and together. However, as illustrated, the release frame 88 is adapted so that the angular wall thereof engages the release pin 82 at an earlier point than the angular wall of the release frame 86 engages the release pin 80. Accordingly, when the crossbar 84 is drawn rearwardly, the pin 82 is cammed inwardly by the release frame 88 to release the latch element 74 from the notch 58 in the piston element 66 during the first portion of the inward travel of the crossbar 84, and the pin 80 is cammed inwardly by the release frame 86 to release the latch element 72 from the notch 58 in the piston element 48 during the last portion of the inward travel of the crossbar 84. As a result, it is possible to operate the trigger assembly 70 for launching a pair of projectiles 23 from the third and fourth launching assemblies 18 and 20 without also launching a pair of projectiles 23 from the first and second launching assemblies 14 and 16, even though the first and second launching assemblies 14 and 16 are in cocked positions and the launching tubes 34 thereof contain projectiles 23. However, once the third and fourth launching assemblies 18 and 20 have been operated for discharging projectiles 23 therefrom, the trigger assembly 70 can still be operated for actuating the first and second launching assemblies 14 and 16 for launching projectiles 23 therefrom. Further, as an alternative to initially launching projectiles 23 from only the third and fourth launching assemblies 18 and 20, it is possible to rapidly draw the crossbar 84 rearwardly to substantially simultaneously launch projectiles 23 from all four of the launching assemblies 14, 16, 18 and 20.

The projectiles 23 are of conventional construction and each includes an elongated shaft foam portion 94 having a tubular bore 96 therein and a suction cup tip portion 98. As illustrated, the projectiles 23 are of slightly rearwardly tapering configuration, and they are adapted to be snugly received in the launching tube 34 so that the projectiles 23 can be effectively launched from launching tubes 34 by delivering compressed air thereto through the outlets 54.

It is seen, therefore, that the instant invention provides an effective new projectile launching device. The device 10 is adapted to be held in a hand of a user so that the user's hand encircles the handle portion 28. When the device 10 is held in this manner, the user can effectively manipulate the trigger element 70 for launching the projectiles 23 from the launching tubes 34. Further, it is possible to selectively launch projectiles from the third and fourth launching assemblies without launching projectiles from the first and second launching assemblies, or to launch projectiles from all four of the launching assemblies substantially simultaneously. Accordingly, it is seen that the projectile launching device of the instant invention has a high level of play value, and that it represents a significant advancement in the art having substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A toy projectile launcher comprising:

a body portion;

first, second, third and fourth launching means on said body portion for launching first, second, third and fourth projectiles therefrom; and actuating means comprising a single trigger element which is operative for simultaneously actuating said first, second, third and fourth launching means to simultaneously launch said first, second, third and fourth projectiles from said body portion.

2. In the toy projectile launcher of claim 1, said first and second launching means comprising first and second piston and cylinder assemblies for launching said first and second projectiles from said body portion.

3. The toy projectile launcher of claim 1 further comprising means for simultaneously moving said first and second launching means to a loaded position.

4. In the toy projectile launcher of claim 1, said trigger element being alternatively operative for substantially simultaneously actuating only two of said launching means or all of said launching means.

5. In the toy projectile launcher of claim 1, said body portion comprising a pair of side portions and a handle portion extending between said side portions, said first and second launching means being mounted on one of said side portions, said third and fourth launching means being mounted on the other of said side portions, said trigger element being mounted on said handle element.

6. In the toy projectile launcher of claim 5 said trigger element being alternatively movable for initially actuating only said first and second launching means, or for substantially simultaneously actuating said first, second, third and fourth launching means.

7. A toy projectile launcher comprising:

a body portion;

a pair of launching means on said body portion, each of said launching means including a pair of barrels and being operative for launching a pair of projectiles from the pair of barrels thereof; and actuating means comprising a single trigger element which is selectively operative for actuating a first one of said launching means for launching a first pair of said projectiles from the respective barrels thereof or for simultaneously actuating both of said launching means for simultaneously launching both pairs of said projectiles from the respective barrels thereof.

* * * * *